US009750342B1

(12) United States Patent
McMillan

(10) Patent No.: US 9,750,342 B1
(45) Date of Patent: Sep. 5, 2017

(54) CORD HOLDER AND ORGANIZER

(71) Applicant: Laurie McMillan, Kimberling City, MO (US)

(72) Inventor: Laurie McMillan, Kimberling City, MO (US)

( * ) Notice: Subject to any disclaimer, the term of this patent is extended or adjusted under 35 U.S.C. 154(b) by 0 days.

(21) Appl. No.: 15/096,596

(22) Filed: Apr. 12, 2016

(51) Int. Cl.
*A47B 81/00* (2006.01)
*B65H 55/00* (2006.01)

(52) U.S. Cl.
CPC ..... *A47B 81/00* (2013.01); *B65H 55/00* (2013.01)

(58) Field of Classification Search
CPC ..... B65H 2701/3915; B65H 2701/34; B65H 2701/30; B65H 75/06; B65H 75/26; B65H 75/265; B65H 55/00; A47F 7/022; A47F 5/02; A47F 5/04; A47F 5/025; A47F 5/06; F21V 17/007; A47B 81/00
USPC ..... 211/163, 166
See application file for complete search history.

(56) References Cited

U.S. PATENT DOCUMENTS 1,137,900 A * 5/1915 Reichert ..... A47F 5/02 211/163
2,614,698 A * 10/1952 Bell ..... A47G 25/00 211/131.1
3,997,050 A * 12/1976 Patterson ..... A47F 7/02 206/566
6,398,148 B1 * 6/2002 Snow ..... B65H 49/28 242/395.1
6,739,566 B1 * 5/2004 Kao ..... A47G 33/126 248/519
7,306,101 B2 * 12/2007 Murry ..... B65H 75/025 206/408
7,350,741 B1 * 4/2008 Rosa ..... B65H 75/265 242/403
8,020,716 B2 * 9/2011 Vitale ..... A47B 57/06 211/197
2004/0206846 A1 * 10/2004 Allen ..... B65H 75/36 242/395.1
2007/0175848 A1 * 8/2007 Mallen ..... A47G 25/0671 211/196
2008/0116157 A1 * 5/2008 Fulbrook ..... A61M 5/1415 211/60.1
2009/0127138 A1 * 5/2009 Allameh ..... A47F 7/02 206/6.1

* cited by examiner

*Primary Examiner* — Patrick Hawn

(57) ABSTRACT

A cord holder and organizer is a device for managing electrical cords when not in use. A plurality of cord holders is removably engaged into a plurality of mounting slots that is evenly distributed along an elongated member. The elongated member is rotatably engaged into a storage container that may be utilized to store accessories and items. An electrical cord may be wrapped around at least one cord wrapping member located on the elongated member and then transferred to one of the plurality of cord holders. A plurality of additional mounting slots is located on the elongated member and allows the positioning of the plurality of cord holders on the elongated member to be adjusted as needed. A plurality of wheels positioned on the storage container enables the device itself to be repositioned.

11 Claims, 8 Drawing Sheets

DETAIL A

CORD HOLDER AND ORGANIZER

FIELD OF THE INVENTION

The present invention relates generally to an organizational device. More specifically, the present invention is a cord holder and organizer for electrical cords when not in use.

BACKGROUND OF THE INVENTION

Electrical cords are often numerous in both residential and commercial environments. As a result, organizing a large number of electrical cords can often be a frustrating task, particularly due to the tendency of electrical cords to twist and tangle. This creates difficulties as the electrical cords must be untwisted and untangled prior to use. Many different types of cord organizers exist, although not without their own drawbacks. One of the most common types of cord organizers is an elongated device around which a cord may be wrapped. The ends of the elongated device typically include an indent for aiding in retaining a cord on the elongated device. A drawback that is inherent to this type of cord organizer is the difficulty of quickly removing the cord from the cord organizer prior to use due to the fact that the cord must be wrapped tightly around the cord organizer in order to prevent separation.

The present invention is a cord holder and organizer for electrical cords when not in use. The present invention provides a means of conveniently managing multiple electrical cords and additionally allows the electrical cords to be easily removed from the present invention prior to use. Additionally, the present invention facilitates the process of wrapping an electrical cord prior to storage. The present invention may further be utilized for storing accessories and items when not in use and to provide electrical power.

DETAIL DESCRIPTIONS OF THE INVENTION

Figure 1:
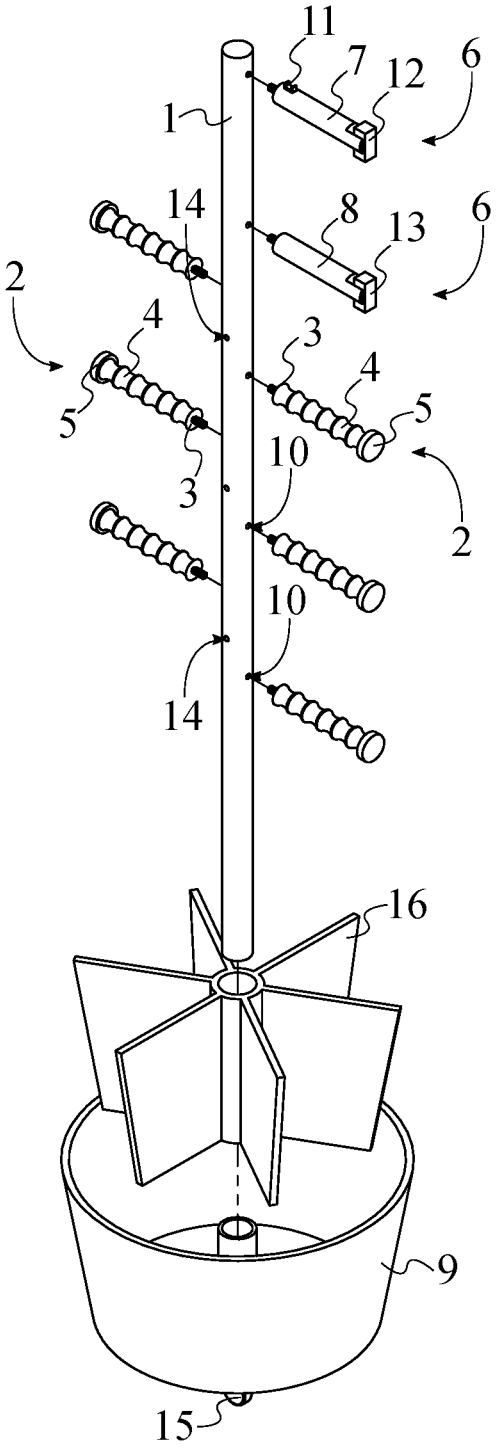
FIG. 1 is an exploded top perspective view of the present invention.

All illustrations of the drawings are for the purpose of describing selected versions of the present invention and are not intended to limit the scope of the present invention.

The present invention is a cord holder and organizer that is utilized for electrical cord storage. The present invention is shown in FIGS. 1-6 and comprises an elongated member 1, a plurality of cord holders 2, at least one cord wrapping member 6, a storage container 9, and a plurality of mounting slots 10. The present invention provides a convenient means of wrapping and storing electrical cords when not in use.

The elongated member 1 serves as a central mounting point for the plurality of cord holders 2 and the at least one cord wrapping member 6. The elongated member 1 is preferably cylindrical and is of a sufficient length such that multiple electrical cords may be stored on the present invention. The plurality of cord holders 2 physically holds electrical cords in place along the elongated member 1. The plurality of mounting slots 10 provides a means of securing the plurality of cord holders 2 in place on the elongated member 1. In the preferred embodiment of the present invention, the plurality of mounting slots 10 is distributed along the elongated member 1 in order to provide sufficient spacing between electrical cords that are stored on the present invention. The plurality of mounting slots 10 traverses into the elongated member 1. As such, fasteners such as screws may be utilized to secure the plurality of cord holders 2 into the elongated member 1. Each of the plurality of cord holders 2 is removably engaged into a corresponding slot from the plurality of mounting slots 10. The plurality of cord holders 2 is removable from the elongated member 1 to allow repositioning of the plurality of cord holders 2 on the elongated member 1 based on the user's needs.

With continued reference to FIGS. 1-6, the at least one cord wrapping member 6 is utilized to aid in wrapping the electrical cords prior to storage on the plurality of cord holders 2. In the preferred embodiment of the present invention, the at least one cord wrapping member 6 is removably engaged into the elongated member 1, similar to the plurality of cord holders 2. This allows the at least one cord wrapping member 6 to be removed from the elongated member 1 if the user desires. The at least one cord wrapping member 6 is offset from the plurality of cord holders 2 along the elongated member 1 and as such, electrical cords that are in the process of being wrapped around the at least one cord wrapping member 6 are kept out of the way of the plurality of cord holders 2.

The storage container 9 is utilized to store accessories and items when not in use and additionally serves as a base for the present invention. The elongated member 1 is rotatably mounted to the storage container 9, allowing the user to adjust the orientation of the plurality of cord holders 2 as needed.

The present invention further comprises a holder tab 11. The holder tab 11 is utilized to anchor one end of an electrical cord while the electrical cord is being wrapped around the at least one cord wrapping member 6. In the preferred embodiment of the present invention, the at least one cord wrapping member 6 comprises a first wrapping member 7 and a second wrapping member 8. An electrical cord may thus be wrapped around both the first wrapping member 7 and the second wrapping member 8 before being transferred to one of the plurality of cord holders 2. The first wrapping member 7 and the second wrapping member 8 are offset from each other along the elongated member 1, easily allowing the electrical cord to be wrapped around both the first wrapping member 7 and the second wrapping member 8. Additionally, the first wrapping member 7 and the second wrapping member 8 are oriented parallel to each other. The parallel orientation of the first wrapping member 7 and the second wrapping member 8 facilitates removal of the electrical cord after being wrapped around the first wrapping member 7 and the second wrapping member 8. The holder tab 11 is laterally connected to the first wrapping member 7. One end of the electrical cord may thus be secured in place on the first wrapping member 7 while the electrical cord is wrapped around the first wrapping member 7 and the second wrapping member 8. The secured end of the electrical cord may then be removed from the holder tab 11 before the electrical cord is removed from the first wrapping member 7 and the second wrapping member 8.

The present invention further comprises a first retractable stopper tab 12 and a second retractable stopper tab 13. The first retractable stopper tab 12 and the second retractable stopper tab 13 are utilized to prevent an electrical cord from sliding off and separating from the first wrapping member 7 and the second wrapping member 8, respectively, while the electrical cord is being wrapped. The first retractable stopper tab 12 and the second retractable stopper tab 13 may be temporarily moved out of the way of the electrical cord in order to allow the electrical cord to be removed from the first wrapping member 7 and the second wrapping member 8 after wrapping is complete. The first retractable stopper tab 12 is hingedly connected to the first wrapping member 7 while the second retractable stopper tab 13 is hingedly connected to the second wrapping member 8. As a result, the first retractable stopper tab 12 is able to keep the electrical cord in place on the first wrapping member 7 while the second retractable stopper tab 13 is able to keep the electrical cord in place on the second wrapping member 8. Additionally, the first retractable stopper tab 12 and the second retractable stopper tab 13 may easily be moved out of the way when the user wishes to remove the electrical cord from the first wrapping member 7 and the second wrapping member 8. The first retractable stopper tab 12 and the second retractable stopper tab 13 are positioned away from the elongated member 1, enabling the electrical cord to be kept in place in between the elongated member 1 and the first retractable stopper tab 12 and the second retractable stopper tab 13.

Figure 6:
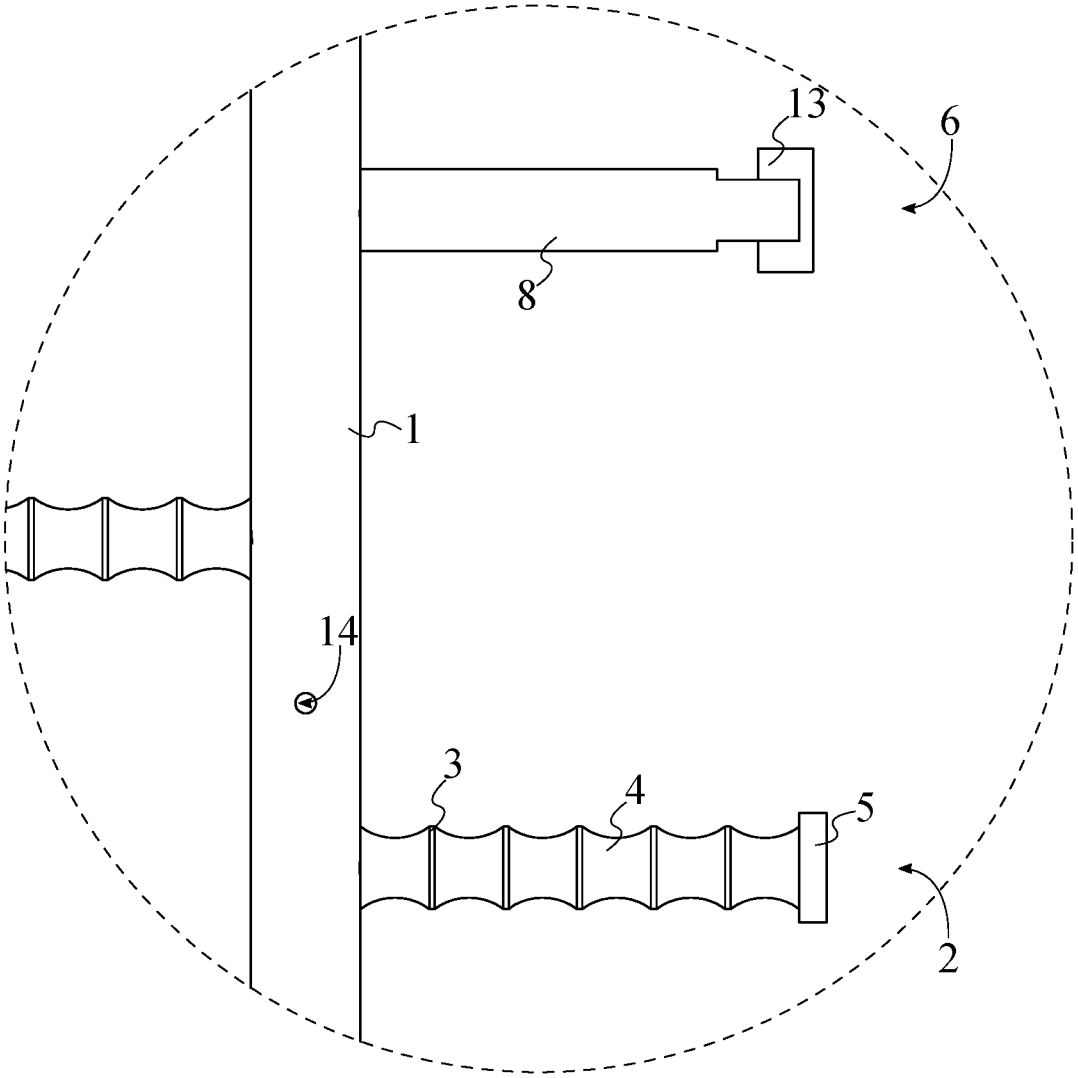
FIG. 6 is a detail view of the present invention taken from circle A of FIG. 5.

As shown in FIG. 6, each of the plurality of cord holders 2 comprises a cylindrical member 3, a plurality of lateral grooves 4, and a stopper tab 5. The cylindrical member 3 serves as a body around which a wrapped electrical cord may be hung. The plurality of lateral grooves 4 aids in keeping the wrapped electrical cord in place around the cylindrical member 3 while the stopper tab 5 prevents the wrapped electrical cord from sliding off and separating from the cylindrical member 3. The plurality of lateral grooves 4 is evenly distributed along the cylindrical member 3 and as such, the plurality of lateral grooves 4 is able to retain the wrapped electrical cord along the length of the cylindrical member 3. The plurality of lateral grooves 4 traverses into the cylindrical member 3 and as such, the wrapped electrical cord may be held in place within the plurality of lateral grooves 4 for secure storage. The stopper tab 5 functions similarly to the first retractable stopper tab 12 and the second retractable stopper tab 13 in that the stopper tab 5 prevents the electrical cord from sliding off and separating from the cylindrical member 3. The stopper tab 5 is connected to the cylindrical member 3, adjacent to the plurality of lateral grooves 4. Additionally, the plurality of lateral grooves 4 is positioned in between the elongated member 1 and the stopper tab 5, enabling the wrapped electrical cord to be kept in place in between the elongated member 1 and the stopper tab 5.

The present invention further comprises a plurality of additional mounting slots 14 as shown in FIGS. 1-5. The plurality of additional mounting slots 14 is utilized to adjust the positioning of the plurality of cord holders 2 on the elongated member 1. The plurality of additional mounting slots 14 is distributed along the elongated member 1, providing multiple positional options for the plurality of cord holders 2 in addition to the plurality of mounting slots 10. Each of the plurality of additional mounting slots 14 is offset from a corresponding slot from the plurality of mounting slots 10 along the elongated member 1. The plurality of additional mounting slots 14 is thus separated from the plurality of mounting slots 10 and provides additional positional options for the plurality of cord holders 2 on the elongated member 1. In addition to being offset from the plurality of mounting slots 10, the plurality of additional mounting slots 14 is oriented perpendicular to the plurality of mounting slots 10. The perpendicular orientation of the plurality of additional mounting slots 14 relative to the plurality of mounting slots 10 provides additional positional options for the plurality of cord holders 2. The plurality of additional mounting slots 14 traverses into the elongated member 1, allowing fasteners such as screws to be utilized to secure the plurality of cord holders 2 within the plurality of additional mounting slots 14.

Figure 4:
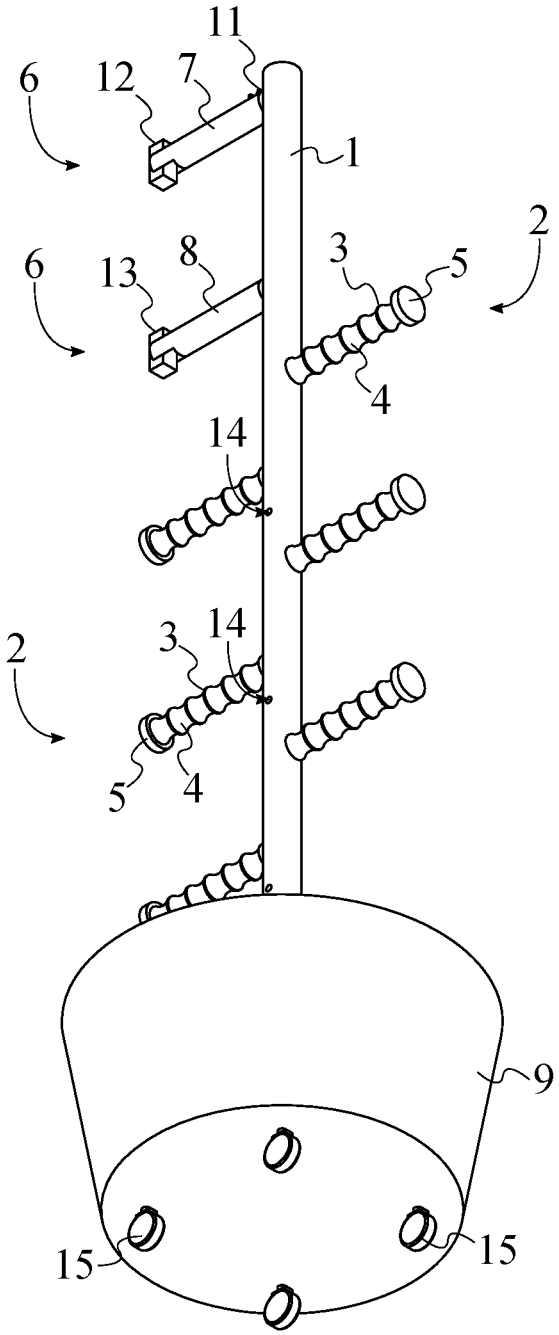
FIG. 4 is a bottom perspective view of the present invention.
Figure 5:
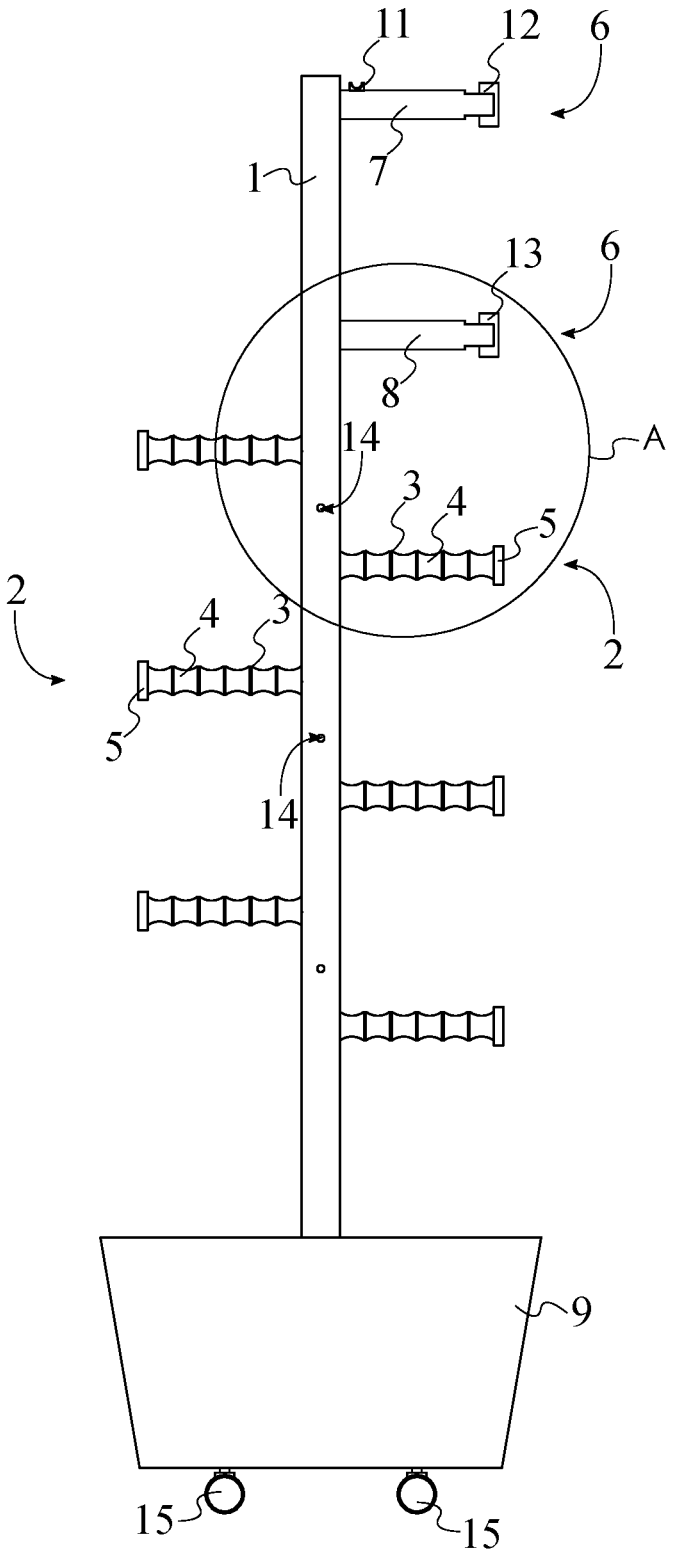
FIG. 5 is a front view of the present invention.

As shown in FIG. 4, the present invention further comprises a plurality of wheels 15. The plurality of wheels 15 enables the present invention to be moved as needed. The plurality of wheels 15 is rotatably mounted to the storage container 9 and thus provides a large degree of movement freedom to the present invention. The plurality of wheels 15 is positioned opposite to the elongated member 1 and may thus come into contact with a surface such as the ground.

Figure 2:
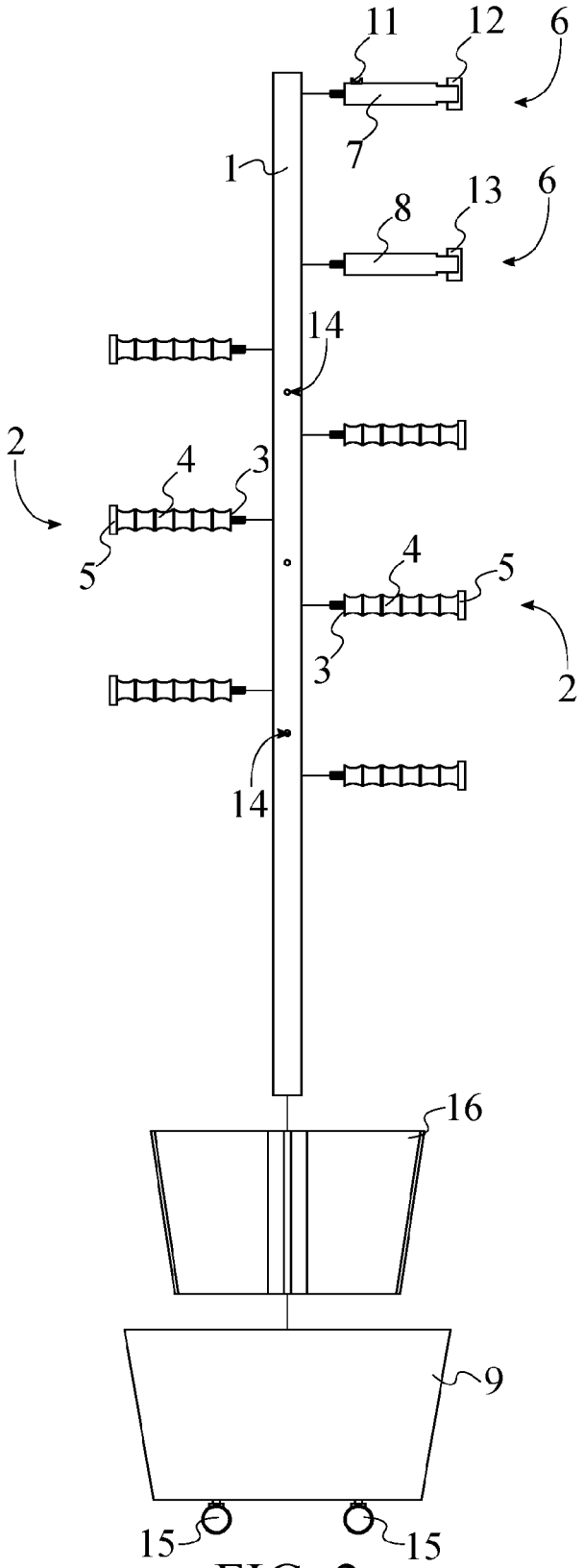
FIG. 2 is an exploded front view of the present invention.
Figure 3:
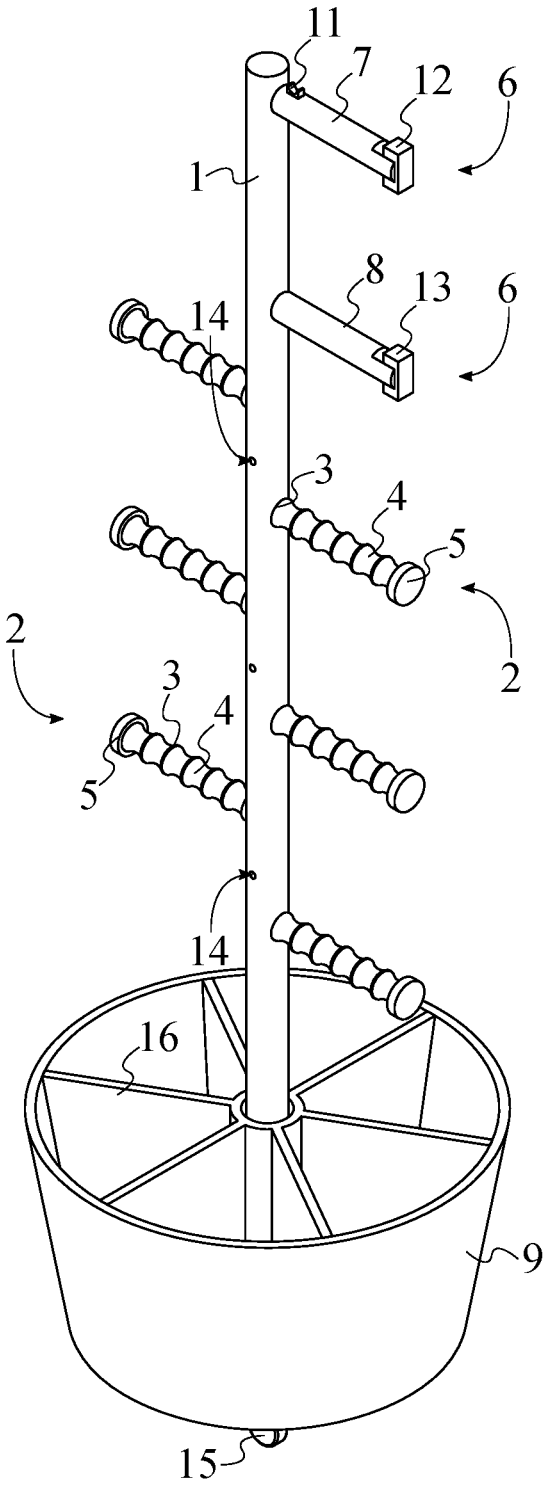
FIG. 3 is a top perspective view of the present invention.
Figure 7:
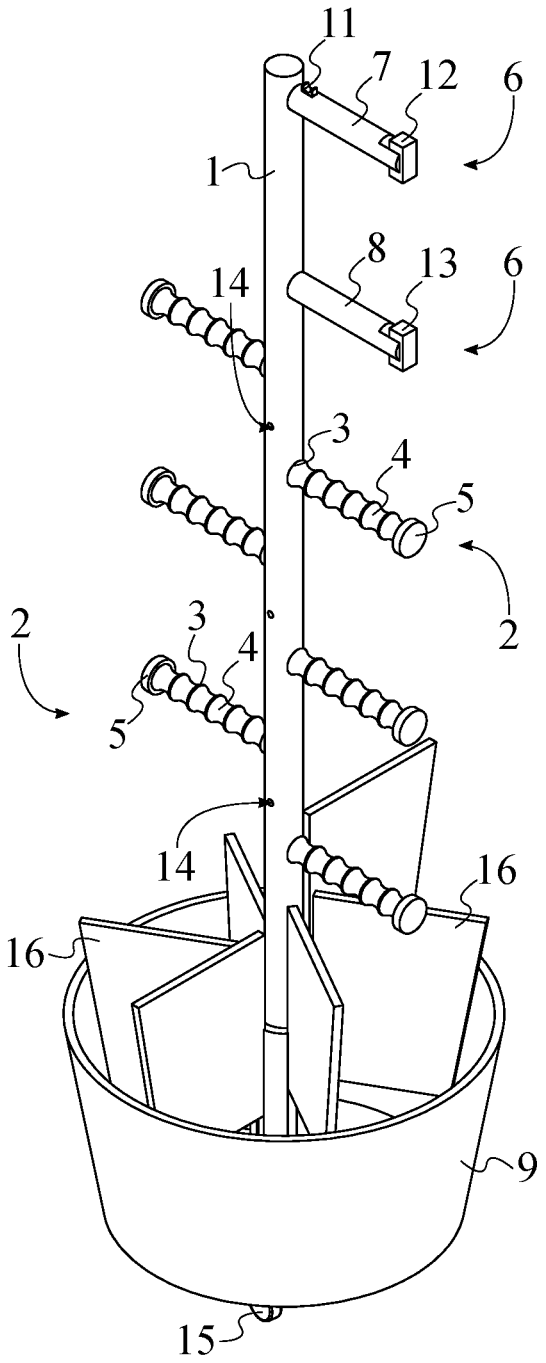
FIG. 7 is a top perspective view of the present invention with multiple of the at least one compartment divider insert.

With reference to FIGS. 1-3, the present invention further comprises at least one compartment divider insert 16. The at least one compartment divider insert 16 is utilized to physically divide the interior of the storage container 9 into multiple smaller compartments in order to increase the organizational capacity of the storage container 9. The at least one compartment divider insert 16 is removably mounted into the storage container 9, allowing the user to utilize the storage container 9 as a single compartment or multiple compartments. The elongated member 1 is rotatably engaged through the at least one compartment divider insert 16, enabling the user to adjust the orientation of the plurality of cord holders 2 while the at least one compartment divider insert 16 is in place within the storage container 9. The present invention is shown with multiple of the at least one compartment divider insert 16 in FIG. 7. This configuration of the present invention allows customization of the storage container 9 based on the user's needs.

Figure 8:
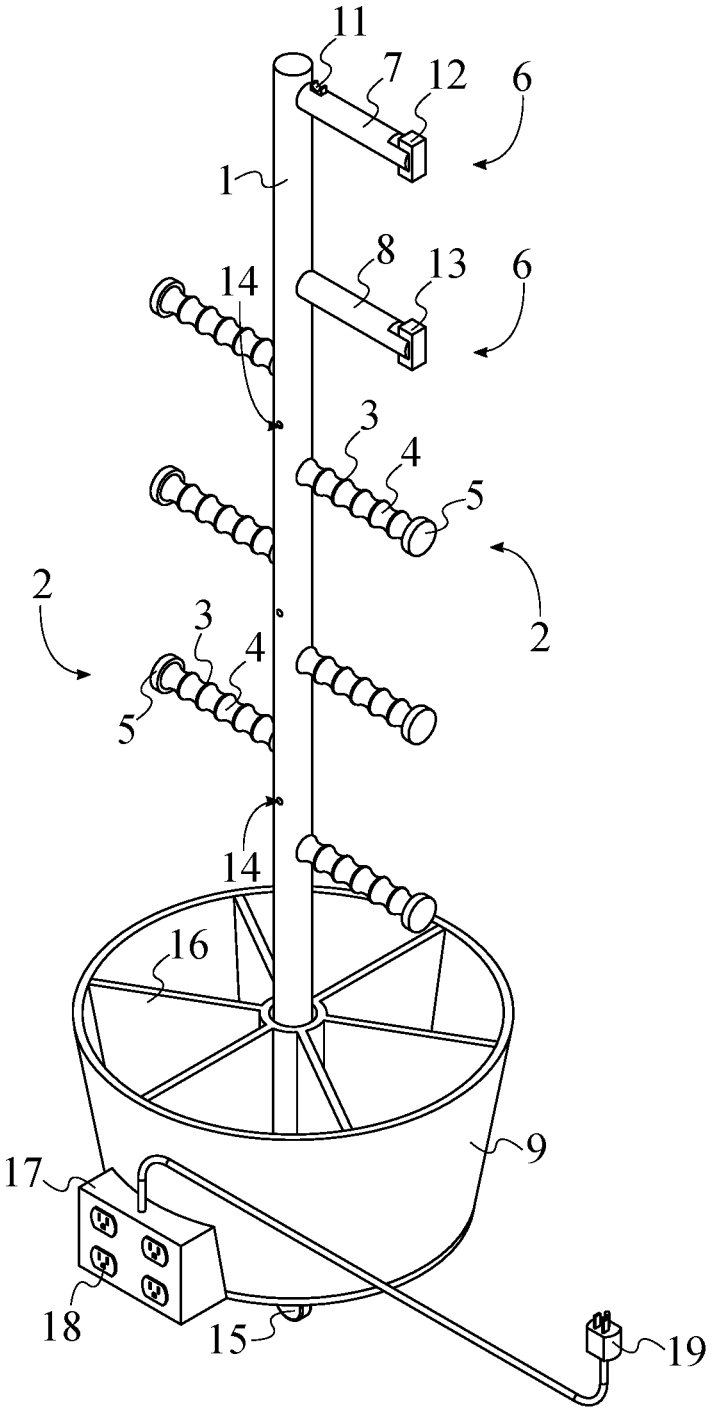
FIG. 8 is a top perspective view of the present invention with a power station, at least one electrical outlet, and an electrical connector.

The embodiment of the present invention shown in FIG. 8 further comprises a power station 17, at least one electrical outlet 18, and an electrical connector 19. The power station 17 is a casing that houses electrical and electronic components. The at least one electrical outlet 18 is utilized to power an electronic device through the present invention while the electrical connector 19 enables the present invention to be connected to an external power source such as an electrical wall outlet. The power station 17 is externally positioned on the storage container 9 and is thus easily accessible by the user. The at least one electrical outlet 18 traverses into the power station 17, enabling one or more electronic devices to be plugged into the power station 17. The electrical connector 19 is externally positioned on the power station 17, allowing the electrical connector 19 to be plugged into an external power source to provide electrical power to the present invention. The electrical connector 19 is electrically connected to the at least one electrical outlet 18, allowing electrical power from the external power source to be provided to the at least one electrical outlet 18 through the electrical connector 19.

Although the present invention has been explained in relation to its preferred embodiment, it is understood that many other possible modifications and variations can be made without departing from the spirit and scope of the present invention as hereinafter claimed.

What is claimed is:

1. A cord holder and organizer comprises:
an elongated member;
a plurality of cord holders;
at least one cord wrapping member;
a storage container;
a plurality of first mounting slots;
the plurality of first mounting slots being distributed along the elongated member;
the plurality of first mounting slots traversing into the elongated member;
each of the plurality of cord holders being removably engaged into a corresponding slot from the plurality of first mounting slots;
the at least one cord wrapping member being removably engaged into the elongated member;
the at least one cord wrapping member being offset from the plurality of cord holders along the elongated member;
the elongated member being rotatably mounted to the storage container;
a holder tab;
the at least one cord wrapping member comprises a first wrapping member and a second wrapping member;
the first wrapping member and the second wrapping member being offset from each other along the elongated member;
the first wrapping member and the second wrapping member being oriented parallel to each other;
the holder tab being laterally connected to the first wrapping member;
a first retractable stopper tab;
a second retractable stopper tab;
the first retractable stopper tab being hingedly connected to the first wrapping member;
the second retractable stopper tab being hingedly connected to the second wrapping member; and
the first retractable stopper tab and the second retractable stopper tab being positioned away from the elongated member.

2. The cord holder and organizer as claimed in claim 1 further comprises:
each of the plurality of cord holders comprises a cylindrical member, a plurality of lateral grooves, and a stopper tab;
the plurality of lateral grooves being evenly distributed along the cylindrical member;
the plurality of lateral grooves traversing into the cylindrical member;
the stopper tab being connected to the cylindrical member, adjacent to the plurality of lateral grooves; and
the plurality of lateral grooves being positioned in between the elongated member and the stopper tab.

3. The cord holder and organizer as claimed in claim 1 further comprises:
a plurality of second mounting slots different from the plurality of first mounting slots;
the plurality of second mounting slots being distributed along the elongated member;
each of the plurality of second mounting slots being offset from a corresponding slot from the plurality of first mounting slots along the elongated member;
the plurality of second mounting slots being oriented perpendicular to the plurality of first mounting slots; and
the plurality of second mounting slots traversing into the elongated member.

4. The cord holder and organizer as claimed in claim 1 further comprises:
a plurality of wheels;
the plurality of wheels being rotatably mounted to the storage container; and
the plurality of wheels being positioned opposite to the elongated member.

5. The cord holder and organizer as claimed in claim 1 further comprises:
at least one compartment divider insert;
the at least one compartment divider insert being removably mounted into the storage container; and
the elongated member being rotatably engaged through the at least one compartment divider insert.

6. The cord holder and organizer as claimed in claim 1 further comprises:
a power station;
at least one electrical outlet;
an electrical connector;
the power station being externally positioned on the storage container;
the at least one electrical outlet traversing into the power station;
the electrical connector being externally positioned on the power station; and
the electrical connector being electrically connected to the at least one electrical outlet.

7. A cord holder and organizer comprises:
an elongated member;
a plurality of cord holders;
at least one cord wrapping member;
a storage container;
a plurality of first mounting slots;
a power station;
at least one electrical outlet;
an electrical connector;
the plurality of first mounting slots being distributed along the elongated member;
the plurality of first mounting slots traversing into the elongated member;
each of the plurality of cord holders being removably engaged into a corresponding slot from the plurality of first mounting slots;
the at least one cord wrapping member being removably engaged into the elongated member;
the at least one cord wrapping member being offset from the plurality of cord holders along the elongated member;
the elongated member being rotatably mounted to the storage container;
the power station being externally positioned on the storage container;
the at least one electrical outlet traversing into the power station;
the electrical connector being externally positioned on the power station;
the electrical connector being electrically connected to the at least one electrical outlet;
a holder tab;
the at least one cord wrapping member comprises a first wrapping member and a second wrapping member;
the first wrapping member and the second wrapping member being offset from each other along the elongated member;

the first wrapping member and the second wrapping member being oriented parallel to each other;

the holder tab being laterally connected to the first wrapping member;

a first retractable stopper tab;

a second retractable stopper tab;

the first retractable stopper tab being hingedly connected to the first wrapping member;

the second retractable stopper tab being hingedly connected to the second wrapping member; and the first retractable stopper tab and the second retractable stopper tab being positioned away from the elongated member.

8. The cord holder and organizer as claimed in claim 7 further comprises:

each of the plurality of cord holders comprises a cylindrical member, a plurality of lateral grooves, and a stopper tab;

the plurality of lateral grooves being evenly distributed along the cylindrical member;

the plurality of lateral grooves traversing into the cylindrical member;

the stopper tab being connected to the cylindrical member, adjacent to the plurality of lateral grooves; and the plurality of lateral grooves being positioned in between the elongated member and the stopper tab.

9. The cord holder and organizer as claimed in claim 7 further comprises:

a plurality of additional second mounting slots different from the plurality of first mounting slots;

the plurality of second mounting slots being distributed along the elongated member;

each of the plurality of second mounting slots being offset from a corresponding slot from the plurality of first mounting slots along the elongated member;

the plurality of second mounting slots being oriented perpendicular to the plurality of first mounting slots; and the plurality of second mounting slots traversing into the elongated member.

10. The cord holder and organizer as claimed in claim 7 further comprises:

a plurality of wheels;

the plurality of wheels being rotatably mounted to the storage container; and the plurality of wheels being positioned opposite to the elongated member.

11. The cord holder and organizer as claimed in claim 7 further comprises:

at least one compartment divider insert;

the at least one compartment divider insert being removably mounted into the storage container; and the elongated member being rotatably engaged through the at least one compartment divider insert.

* * * * *